US011697071B2

(12) United States Patent
Seymour et al.

(10) Patent No.: US 11,697,071 B2
(45) Date of Patent: Jul. 11, 2023

(54) MODULAR SLIDE APPARATUS AND SYSTEM

(71) Applicant: True Play, LLC, Lindon, UT (US)

(72) Inventors: Kendall Seymour, Lindon, UT (US); Andrew Webb, Lindon, UT (US); Jacob Webb, Lindon, UT (US); James Webb, Salt Lake City, UT (US)

( * ) Notice: Subject to any disclaimer, the term of this patent is extended or adjusted under 35 U.S.C. 154(b) by 0 days.

(21) Appl. No.: 17/481,282

(22) Filed: Sep. 21, 2021

(65) Prior Publication Data

US 2022/0088496 A1 Mar. 24, 2022

Related U.S. Application Data

(60) Provisional application No. 63/080,893, filed on Sep. 21, 2020.

(51) Int. Cl.
*A63G 21/00* (2006.01)
*A63G 21/02* (2006.01)

(52) U.S. Cl.
CPC ..... *A63G 21/00* (2013.01)

(58) Field of Classification Search
CPC ..... A63G 21/00; A63G 21/02; A63G 21/10; A63G 21/18
USPC ..... 472/116–117
See application file for complete search history.

(56) References Cited

U.S. PATENT DOCUMENTS 4,813,663 A 3/1989 Rice
4,943,048 A 7/1990 Hentges
5,197,924 A 3/1993 Gerrells
9,308,460 B1 4/2016 Chin
2005/0265777 A1* 12/2005 Lin ..... F16B 5/0685 403/169

FOREIGN PATENT DOCUMENTS

CN 210786220 6/2020

OTHER PUBLICATIONS

Rodriquez "PCT International Search Report for International Application No. PCT/US2021/051381" dated Jan. 5, 2022, 2 pages.
Rodriquez "Written Opinion of the International Searching Authority for International Application No. PCT/US2021/051381" dated Jan. 5, 2022, 6 pages.

* cited by examiner

*Primary Examiner* — Kien T Nguyen
(74) *Attorney, Agent, or Firm* — Intellectual Strategies

(57) ABSTRACT

A modular slide for use on a staircase includes at least a first slide module with an entry section having an entry surface defining a seat and a gripping surface substantially opposite the entry surface. The modular slide also has a ramp section with an elongated surface extending from the entry section towards a terminal end of the ramp section, an underside being configured to rest upon portions of the staircase, and two opposing sidewalls spanning both the ramp section and the entry section and having an upper edge defining a handrail. An identical second slide module is configured to overlap and integrate with an upper portion of the first slide module to form a continuous slide surface and a continuous handrail of an extended modular slide.

13 Claims, 15 Drawing Sheets

MODULAR SLIDE APPARATUS AND SYSTEM

CROSS-REFERENCE TO RELATED APPLICATIONS

This application claims the benefit of and priority to U.S. Provisional Patent Application Ser. No. 63/080,893 filed on Sep. 21, 2020 and entitled "Stairslide," which application is expressly incorporated herein by reference in its entirety.

BACKGROUND

Technical Field

This disclosure generally relates to staircase slides. More specifically, the present disclosure relates to slides that may be mounted on a staircase for recreational use.

Related Technology

Playground equipment for use at home has become an increasingly popular alternative to attending a playground away from home. For instance, many households own an outdoor playground that includes a standing slide. Standing slides are also available for indoor use but can be cumbersome to move about the house and can take up an undesirable amount of space. Slides designed for mounting on a staircase are also available but generally require a tedious and difficult installation process to affix the slide (either permanently or indefinitely) to the staircase and difficult to remove from the staircase because of their size, length, weight, or component quality. Additionally, the installed slides can be a safety hazard when left on the stairs in avoidance of the difficult task of removal.

The subject matter claimed and disclosed herein is not limited to embodiments that solve any disadvantages or that operate only in environments such as those described above. Rather, this background is only provided to illustrate one exemplary technology area where some embodiments described herein may be practiced.

BRIEF SUMMARY

Embodiments of the present disclosure solve one or more of the foregoing or other problems in the art with systems, methods, and apparatuses for mounting a modular slide on a set of stairs or sloped structure. Accordingly, a modular slide apparatus and assembly, and a method for using the same, are disclosed.

In particular, one or more embodiments can include a modular slide for use on a staircase with at least a first slide module including an entry section having an entry surface defining a seat and a gripping surface substantially opposite the entry surface. The modular slide can also have a ramp section with an elongated surface extending from the entry section towards a terminal end of the ramp section, an underside being configured to rest upon portions of the steps or stairs of the staircase, such as one or more stair or step nosings, and two opposing sidewalls spanning both the ramp section and the entry section and having an upper edge defining a handrail. An identical second slide module can be configured to overlap and integrate with an upper portion of the first slide module to form a continuous slide surface and a continuous handrail of an extended modular slide.

Systems of the present disclosure can include modular slide assembly for use on a staircase, the modular slide assembly including first and second slide modules. Each slide module can include an entry section having an entry surface and a ramp section having an elongated surface. The entry surface defines a seat for a user to position oneself near the top of the slide assembly, and the elongated surface acts as a sliding surface for the user. The entry section also can include a gripping surface substantially opposite the entry surface, the gripping surface being configured to interface with a tread of a stair or a step of the staircase to hold the slide assembly in place. Each slide module also can include left and right sidewalls, each having a smooth upper portion or edge defining a handrail. An underside of the first slide module can be sized and shaped to integrate with the entry surface and the elongated surface of the second slide module to form a modular slide having an extended ramp section.

Methods of the present disclosure for installation of a modular slide can include installing a first slide module on a first step or stair, wherein a gripping surface on an underside of the first slide module interfaces with a tread of the first step or stair, and wherein a ramp section of the first slide extends over one or more successive steps below the first step or stair, each of the one or more successive steps or stairs being located below the first step or stair. Further, a second slide module can be installed on a second step or stair, the second step or stair being at least one step above the first step or stair, wherein a gripping surface on an underside of the second slide module interfaces with a tread of the second step or stair, and wherein a ramp section of the second slide module overlaps and integrates with an upper portion of the first slide module to form a continuous slide surface.

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages will be set forth in the description which follows, and in part will be obvious from the description, or may be learned by the practice of the teachings herein. Features and advantages of the invention may be realized and obtained by means of the instruments and combinations particularly pointed out in the appended claims. Features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features can be obtained, a more particular description of the subject matter briefly described above will be rendered by reference to specific embodiments which are illustrated in the appended drawings. Understanding that these drawings depict only typical embodiments and are not therefore to be considered to be limiting in scope, embodiments will be described and explained with additional specificity and detail through the use of the accompanying drawings in which.

Figure 1:
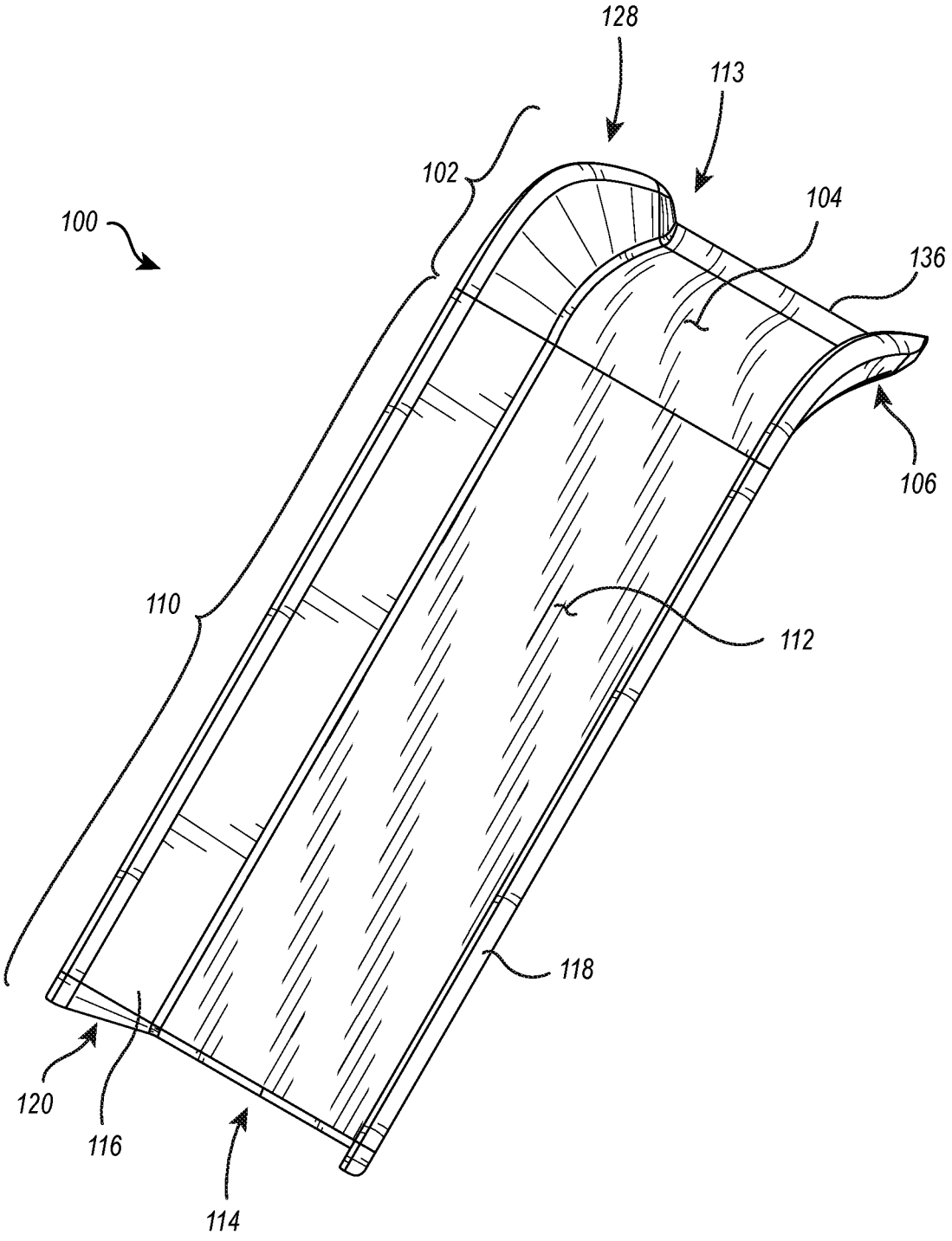
FIG. 1 illustrates a front perspective view of a modular slide apparatus.

The drawing figures are not necessarily drawn to scale. Instead, they are drawn to provide a better understanding of the components and features and are not intended to be limiting in scope but to provide exemplary illustrations. The figures illustrate exemplary configurations of a modular slide apparatus and system or assembly according to embodiments of the present disclosure.

DETAILED DESCRIPTION

Before describing various embodiments of the present disclosure in detail, it is to be understood that this disclosure is not limited to the parameters of the particularly exemplified systems, assemblies, methods, apparatus, products, processes, and/or kits, which may, of course, vary. Thus, while certain embodiments of the present disclosure will be described in detail, with reference to specific configurations, parameters, components, elements, etc., the descriptions are illustrative and are not to be construed as limiting the scope of the claimed invention. In addition, the terminology used herein is for the purpose of describing the embodiments and is not necessarily intended to limit the scope of the claimed invention.

Current solutions for providing a recreational slide for use on a staircase generally requires permanent or semi-permanent installation, are difficult to carry due to excessive weight and size, do not provide sufficient structural support for the user, are subject to short-lived usability due to the user of delicate component materials, and are limited in their compatibility with staircases varying in dimensions. Such slides are often custom made for a particular staircase and can thus be exceedingly expensive while limited in use.

Embodiments of the present disclosure enable slides for use on staircases of virtually any height, grade, and number of steps or stairs by providing a modular slide or modular slide assembly that is simple to install, relatively inexpensive to manufacture, easy to carry and move, and versatile in its ability to be adapted to cover any number of steps or stairs. Embodiments disclosed herein exhibit improvements over currently available staircase slides, while providing a safe and durable recreational product suitable for children.

The illustrated embodiments strike a balance between spanning a desirable number of steps or stairs and a module size and weight that is easy to carry and reposition. The singular use of the terms "step" and "stair" will be used interchangeably to refer to a structure that includes a riser and a tread, with one or more "steps" or "stairs" forming a staircase, flight of stairs, stairway, etc. The singular use of the terms "step" and "stair" also refers to a structure that includes floating tread, without a riser, such that the plural use of the term "steps" or "stairs" can reference to a floating staircase, flight of stairs, stairway, etc.

Referring to FIGS. 1 through 10, various views of a modular slide 100 for use on a staircase are illustrated. The modular slide 100 may be constructed in multiple parts or as a single piece. For instance, a substantial portion of modular slide 100 can be constructed of a single piece of a polymeric material, such as Acrylonitrile Butadiene Styrene (ABS) plastic or similar material, resulting in a rigid, durable, and lightweight apparatus. The modular slide 100 can, alternatively, be formed of polymers, Polyphenylene Ether (PPE), Nylon Filament, Poly-Hydroxybutyrate (PHB) based material, or other materials that provide the desired rigidity and durability, such as that are achieved by ABS.

As illustrated in FIGS. 1 through 10, modular slide 100 can include an entry section 102 having an entry surface 104 defining a seat for a user to position oneself in preparation for sliding down modular slide 100. Entry section 102 can also include a gripping surface 106 substantially opposite to entry surface 104 and being configured to interface with a tread of a stair of the staircase. Extending from the entry section 102 is a ramp section 110 having an elongated surface 112. The ramp section 110 extends from entry surface 104 of entry section 102 at a downward angle towards a terminal end 114 of ramp section 110. As illustrated in FIG. 1, entry section 102 and ramp section 110 form a single slide module 100, such that entry surface 104 and elongated surface 112 form a continuously smooth surface for sliding that extends between from an upper end 113 to a terminal lower end 114. In some embodiments, elongated surface 112 includes a curved lip 115 (FIG. 2) at terminal end 114 to provide for a more comfortable and safer exit point for a sliding user.

The length of ramp section 110 may be altered from that shown in the Figures depending on the dimensions of the staircase intended for use. In an exemplary embodiment, ramp section 110 is configured to span three stairs of a standard residential staircase. Also, the angle θ (FIG. 5) at which modular slide 100 is used depends on the pitch of the staircase upon which modular slide 100 is installed. For example, staircase pitches upon which modular slide 100 may be used include but are not limited to angles θ between about 20 degrees and about 50 degrees, between about 25 degrees and about 40 degrees, and between about 30 and about 35 degrees.

Figure 5:
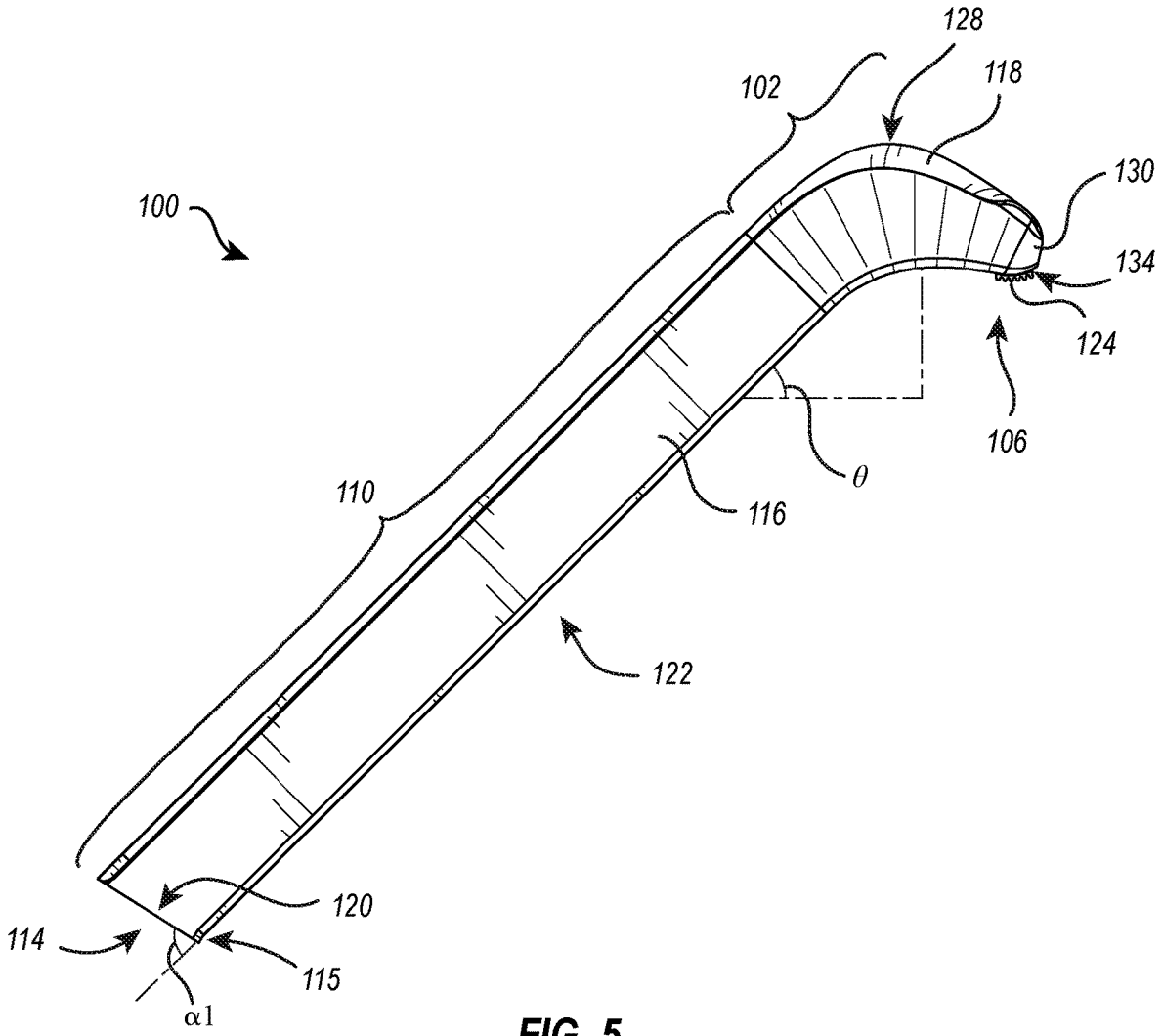
FIG. 5 illustrates a left elevation view of a modular slide apparatus.
Figure 6:
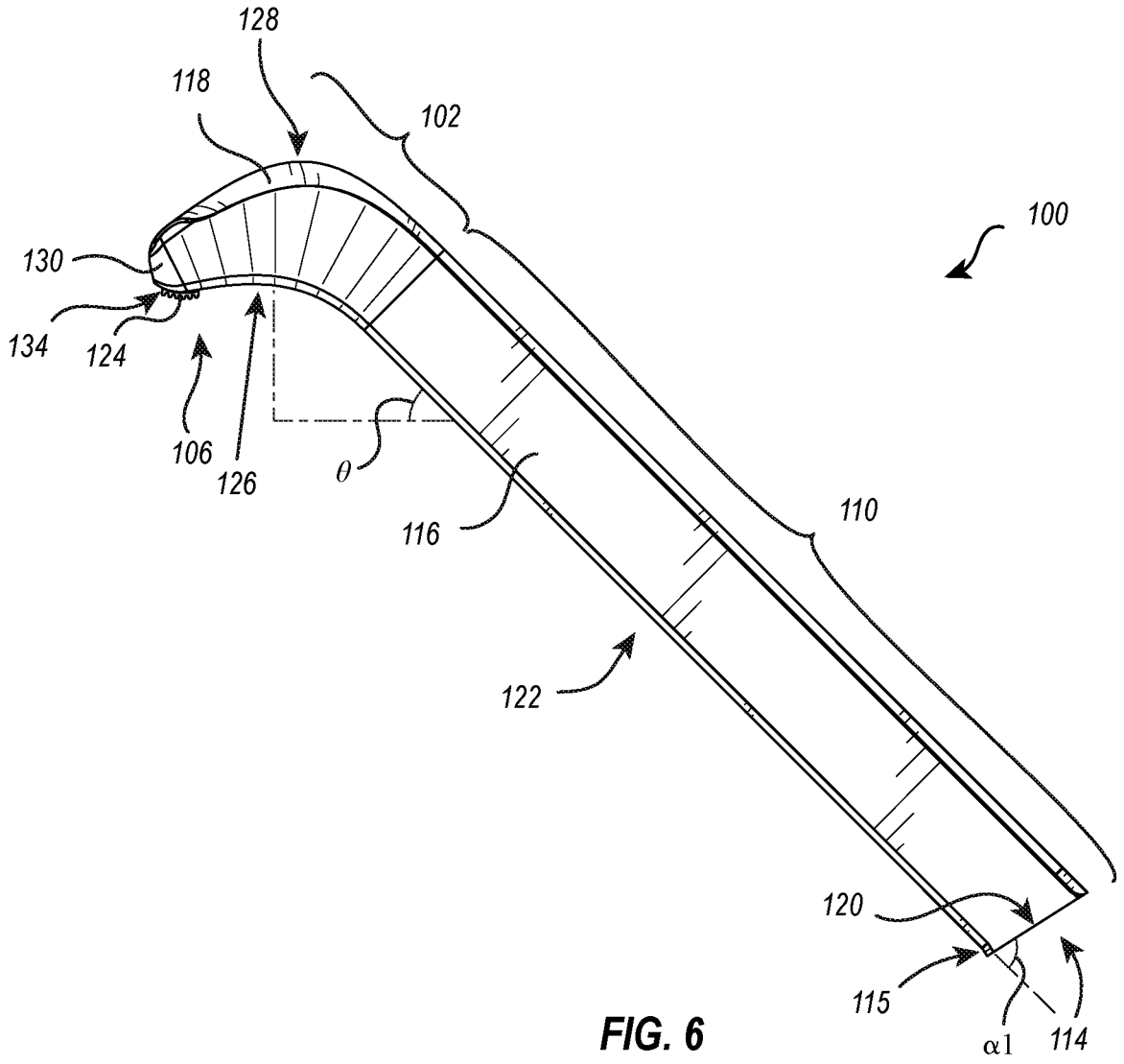
FIG. 6 illustrates a right elevation view of a modular slide apparatus.
Figure 7:
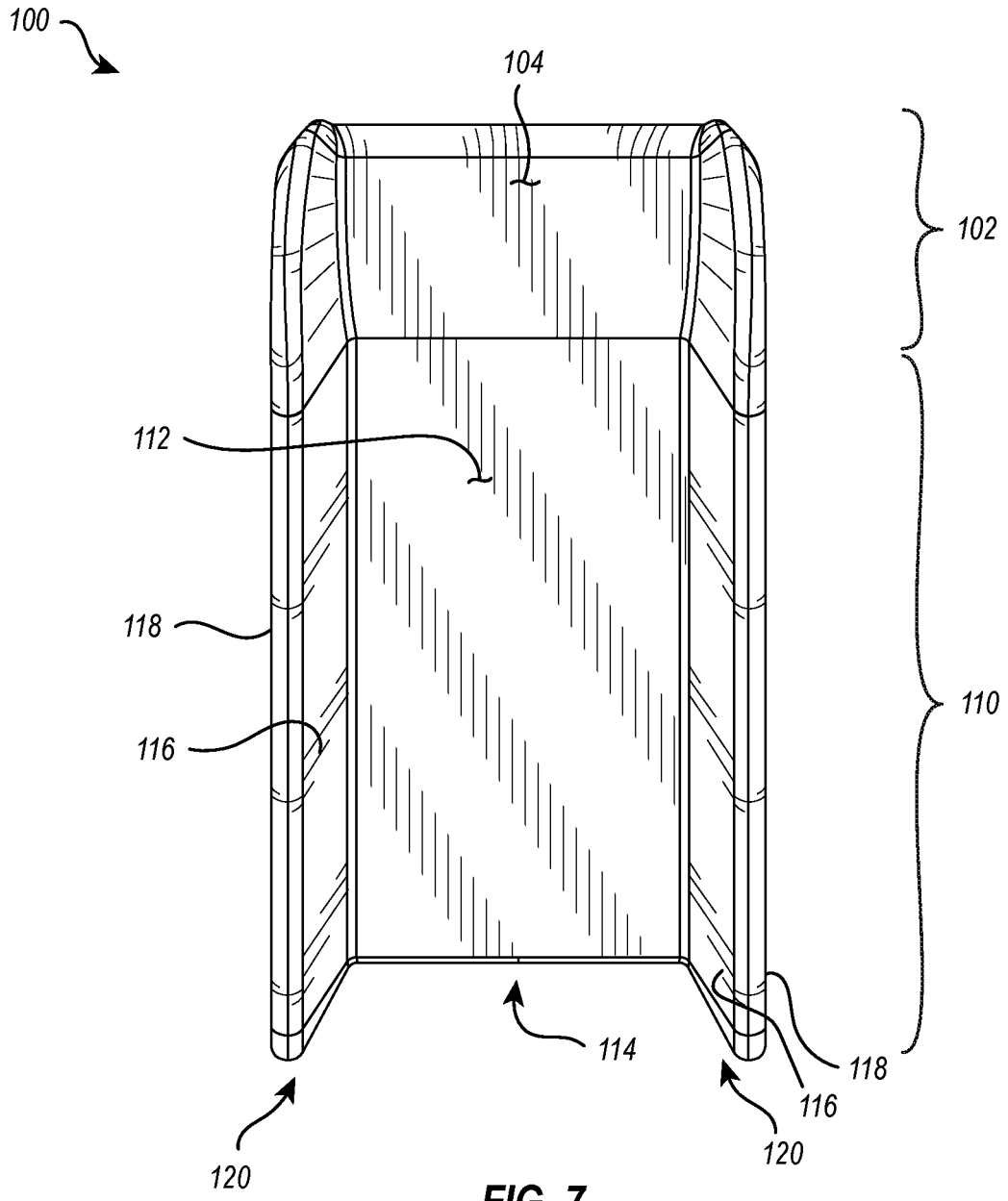
FIG. 7 illustrates a top plan view of a modular slide apparatus.
Figure 8:
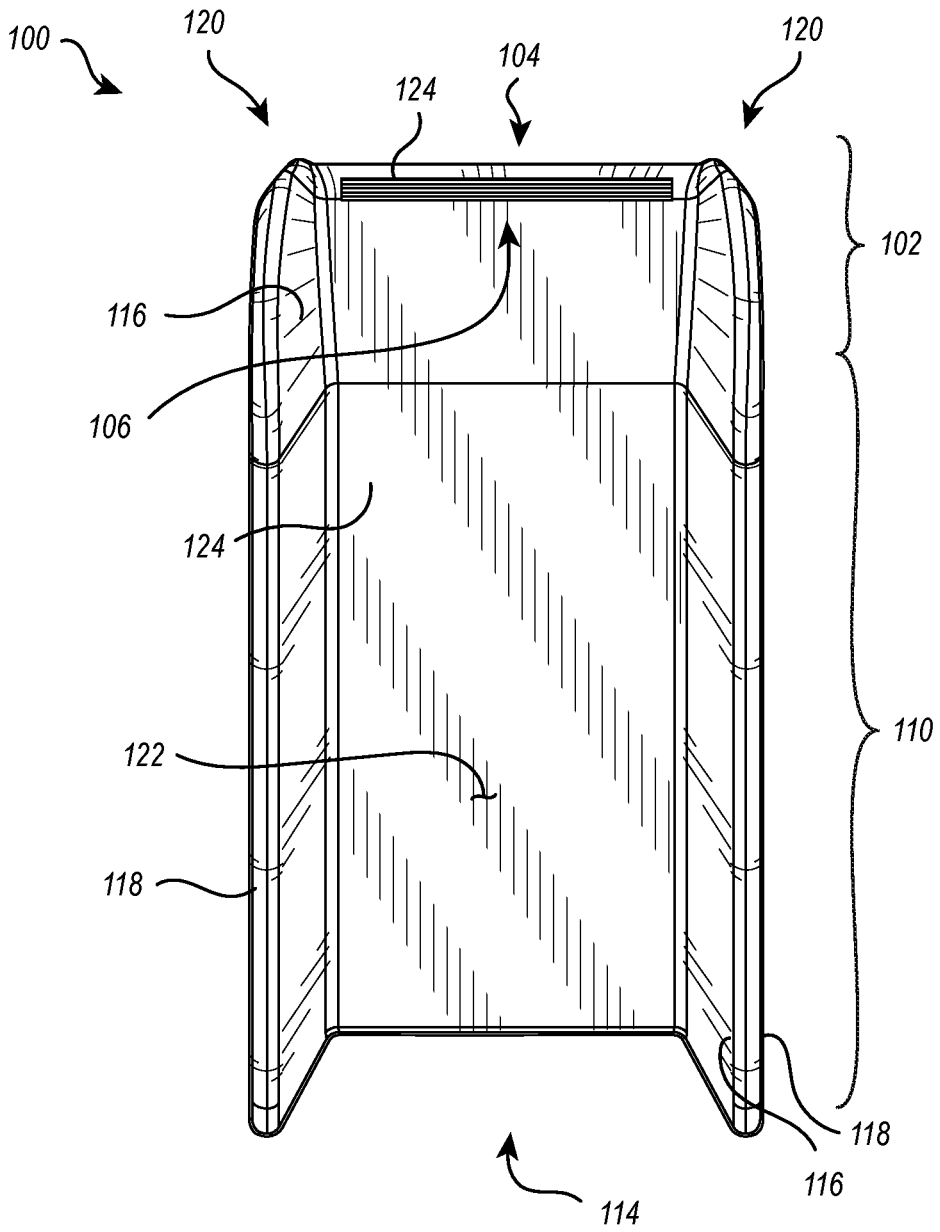
FIG. 8 illustrates a bottom plan view of a modular slide apparatus.

As illustrated in FIG. 1, for instance, one or more sidewalls 116 span opposing lateral sides of ramp section 110 and the entry section 102, each sidewall 116 includes an upper edge 128 having a smooth upper surface, such that a handrail 118 is provided. In at least one embodiment, handrail 118 spans the entire length of modular slide 100 from the entry section 102 to the ramp section 110, thus providing support for the user's hand or hands both while sitting on entry surface 104 and while sliding down elongated surface 112. As depicted in FIGS. 1, 5 and 6, each sidewall 116 may include a terminal edge 120 proximate to terminal end 114 of ramp section 110, wherein terminal edge 120 is angled forward or, in other words, away from entry section 102 by an angle α1 between the terminal edge 120 and a virtual line extending from the elongated surface 112 and parallel to the elongated to the elongated surface 112. Angle α1, for example, can be 90 degrees or less, such as but not limited to approximately about 80 degrees or between about 75 degrees and about 85 degrees. Such configuration of terminal edge 120 facilitates stacking of one modular slide onto another modular slide as further described herein.

Figure 9:
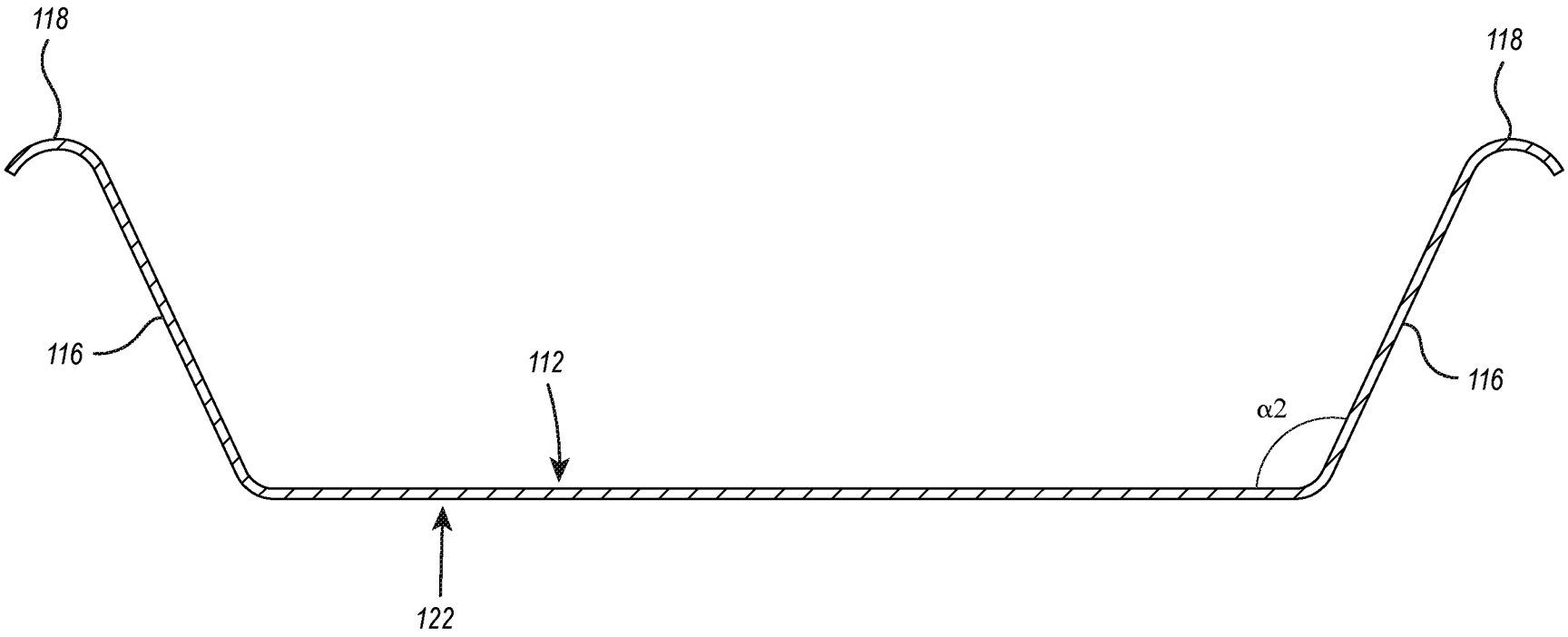
FIG. 9 illustrates a lateral cross-sectional view of a modular slide apparatus.

Also, as depicted in FIG. 9, some embodiments include two sidewalls 116 that extend upward at an angle α2 with respect to elongated surface 112, thus providing additional space for a user while sliding, as well as facilitation of stacking one modular slide onto another modular slide. For example, angle α2 between each sidewall 116 and elongated surface 112 can be at least 90 degrees, such as but not limited to approximately about 115 degrees, between about 90 degrees to about 130 degrees, between about 100 degrees to about 125 degrees, or between about 110 degrees to about 120 degrees.

Figure 2:
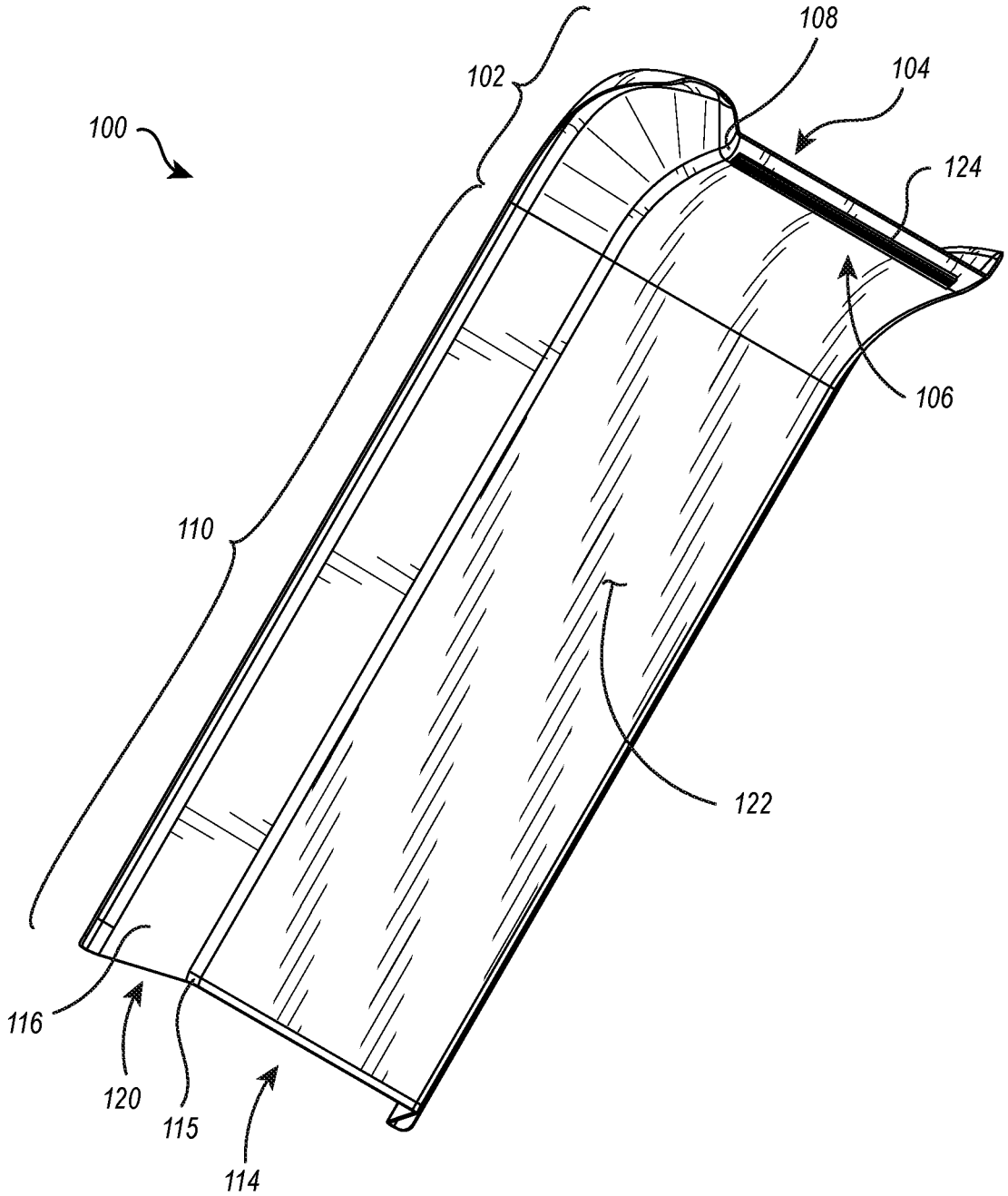
FIG. 2 illustrates a rear perspective view of a modular slide apparatus.
Figure 3:
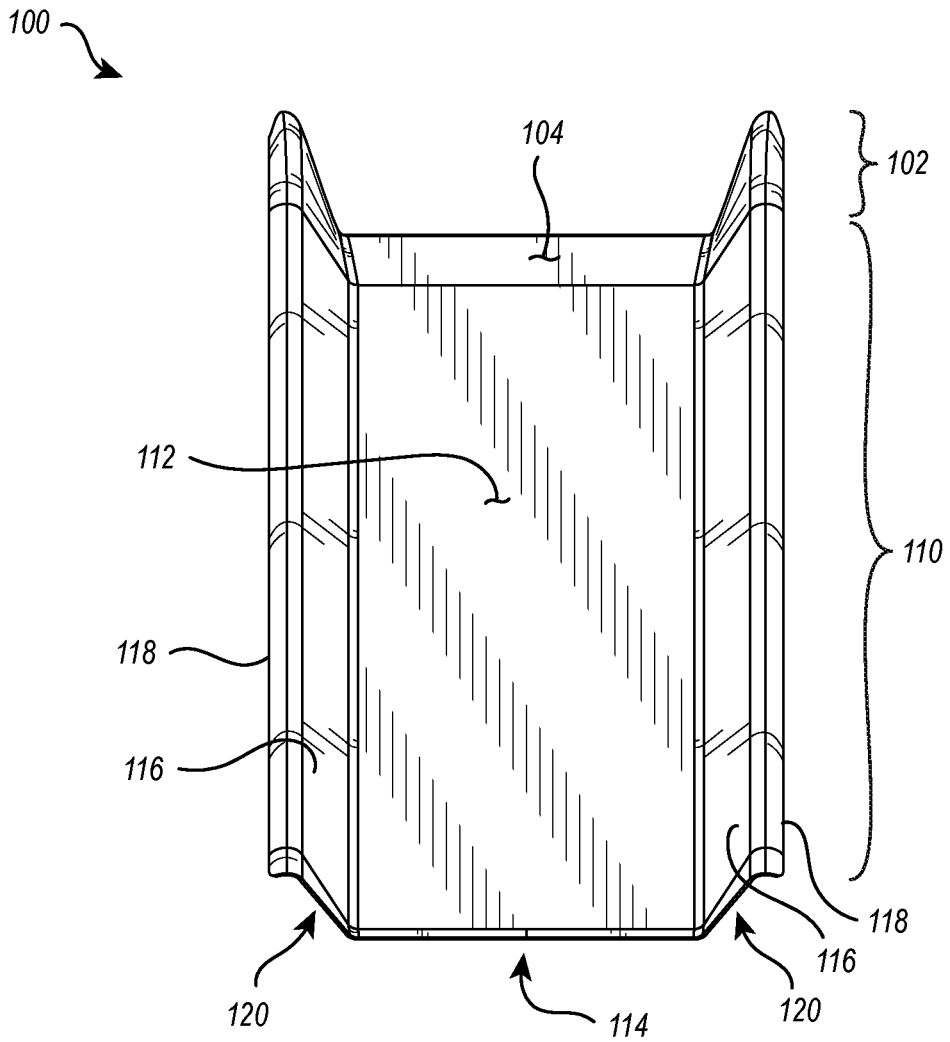
FIG. 3 illustrates a front elevation view of a modular slide apparatus.
Figure 4:
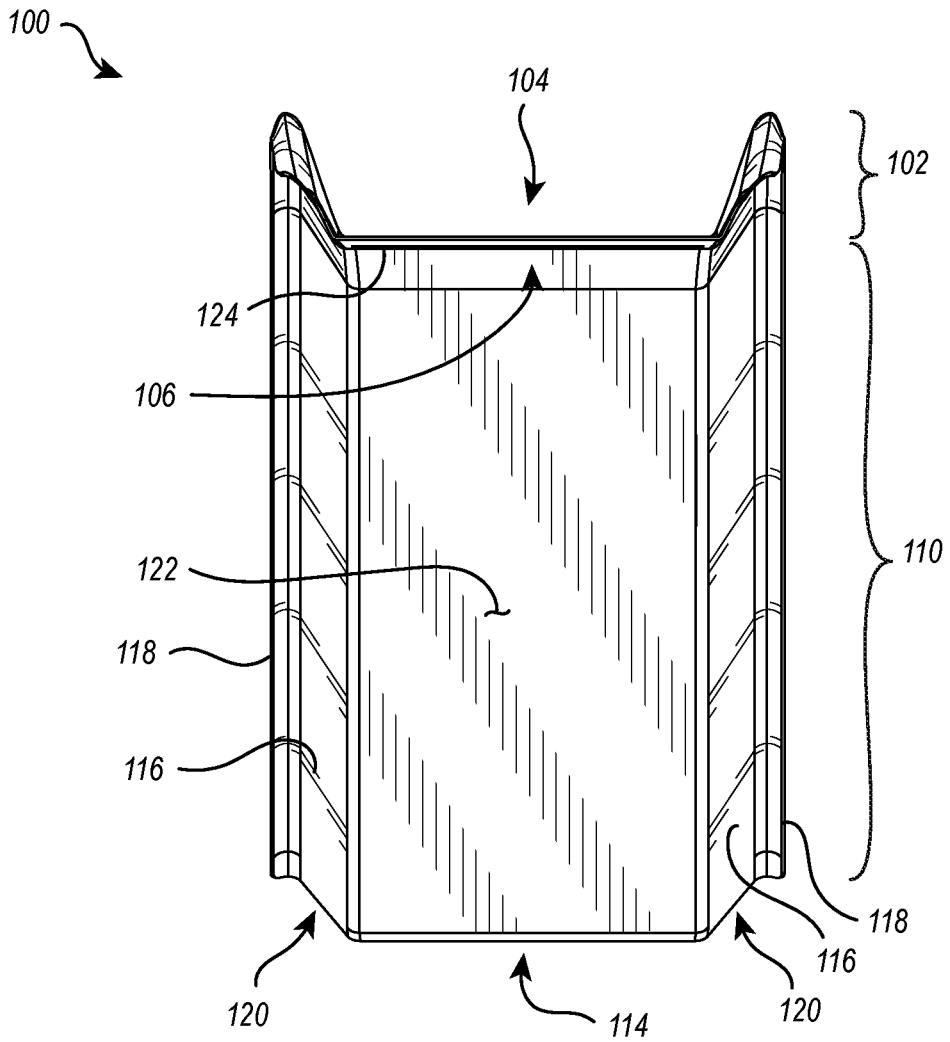
FIG. 4 illustrates a rear elevation view of a modular slide apparatus.
Figure 10:
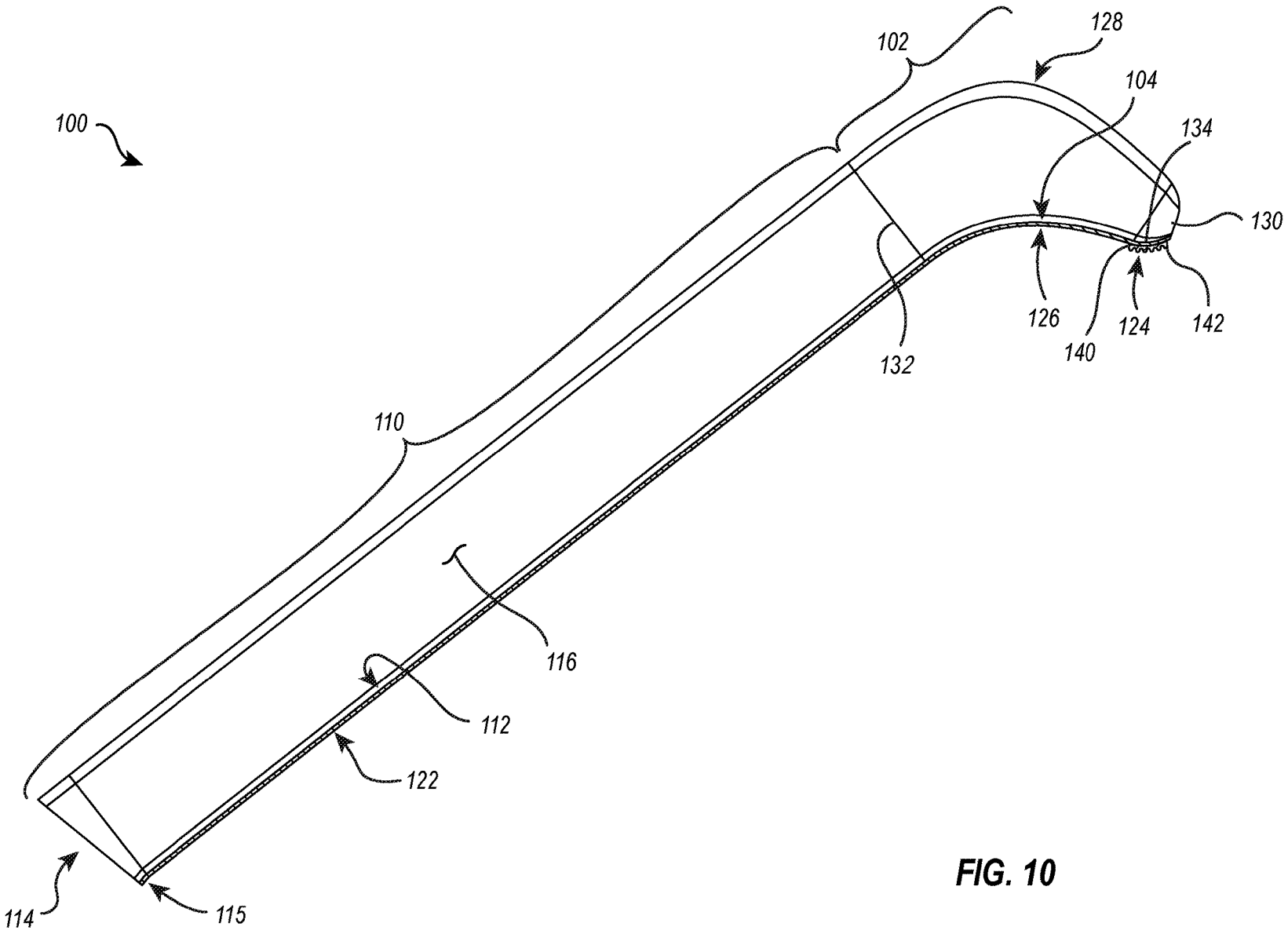
FIG. 10 illustrates a longitudinal cross-sectional view of a modular slide apparatus.

As shown in FIGS. 2 and 10, entry section 102 includes a curved lateral profile between gripping surface 106 and an upper end 132 of ramp section 110 where entry section 102 and ramp section 110 meet, such that entry surface 104 is suspended or positioned above a tread of a stair when the modular slide 100 is in use. For instance, and as illustrated in FIG. 10, the curved lateral profile of entry section 102 is defined by a lower curve 126 and a curve of the upper edge 128, the two curves being separated by sidewall 116 at the upper end 132 of ramp section 110 and coming together near gripping surface 106 to form a nose 130 of entry section 102. Lower curve 126 also provides for a smooth transition between elongated surface 112 and entry section 104, and provides a seating area for a user to sit upon when preparing to slide down modular slide 100.

Additionally, lower curve 126 can include an upward curve 134 at nose 130 to form a recessed portion 136 in the entry section 102 that extends across a width of the modular slide 100. The upward curve 134 includes at least a portion of the gripping surface 106 to form an increased surface area for interface with the tread of a stair when in use. While the gripping surface 106 is illustrated as being generally curved, in some embodiments the upward curve 134 includes a generally planar portion that accommodates gripping surface 106 so the gripping portion 106 can have a generally planer configuration. In either case, with gripping surface 106 substantially opposite of the seat defined by entry surface 104, the weight of a user is applied between the tread of the stair and gripping surface 106 when the user enters and sits on entry surface 104, thus mounting modular slide 100 to the stair while in use without the need for additional hardware.

Modular slide 100 is configured to be installed on a staircase by placing gripping surface 106 on a tread of an upper step of the staircase, such that ramp section 110 extends over one or more successive steps below the upper step. When installed, an underside 122 of ramp section 110 rests upon a nosing or other portion of each of the one or more successive steps. For additional positioning of the modular slide 100 on a staircase, gripping surface 106 can include a gripping structure 124 to increase frictional engagement, i.e., increased coefficient of friction, between the tread of the upper step and gripping surface 106. As illustrated in FIG. 10, the gripping structure 124 can include a plurality of protruding portions 142 that extend from a body 140. The protruding portion 142 provide increased frictional and optionally mechanical engagement with a material forming or disposed upon a tread of the staircase, such as wood, metal, carpet, or other surface coating or finish of a tread of the staircase. The gripping structure 124 can be formed of rubber, polymer, or other material that aids with engagement and helps prevent unwanted movement between the modular slide and a tread of the staircase, whether or not such movement is transverse to or in the direction of elongation of the ramp section 110 of the modular slide 100.

As mentioned previously, modular slide 100 enables extension of the overall slide surface by arranging multiple slide modules 100 in succession on a staircase, such that terminal end 114 of ramp section 110 interfaces or overlaps with another slide module to form a modular slide assembly of increased length. As shown throughout the Figures, modular slide 100 is sized and shaped such that it may overlap and nest with any additional modular slide 100 of identical shape and size to form an extended modular slide. This is illustrated in FIGS. 11-15 where numeral qualifiers (i.e., first, second, etc.) are used merely for explanatory purposes and not intended to limit the location or number of features or components of the embodiments or uses of the modular slides described herein or otherwise contemplated by the present disclosure.

Figure 11:
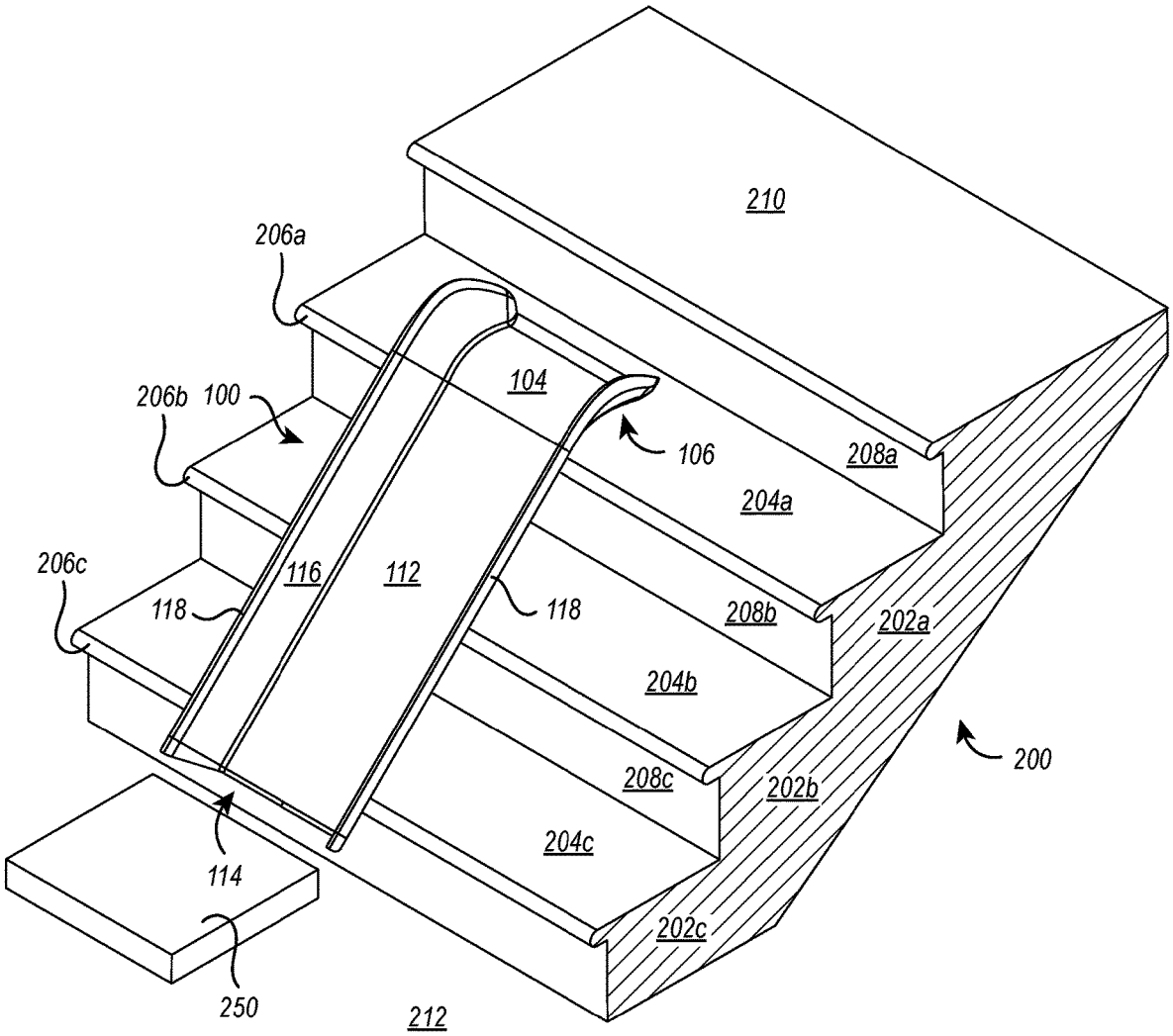
FIG. 11 illustrates a front perspective view of a modular slide apparatus installed on a staircase.
Figure 12:
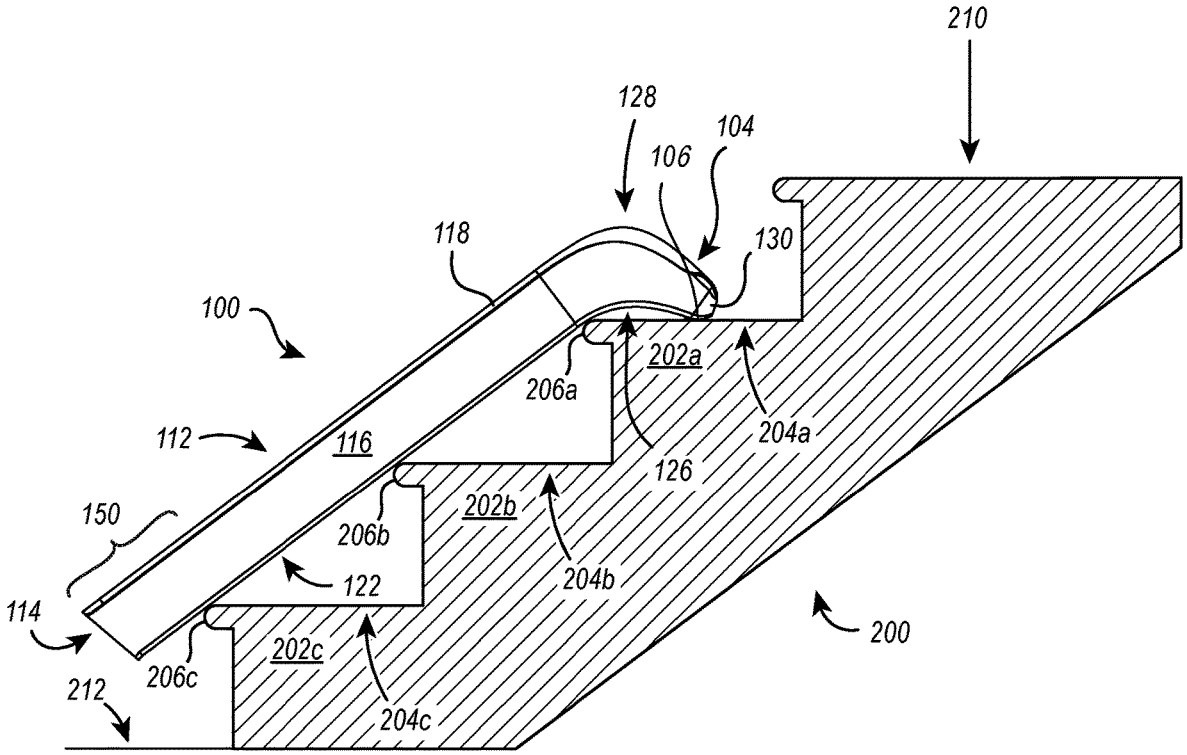
FIG. 12 illustrates a side profile view of a modular slide apparatus installed on a staircase.

Referring to FIGS. 11 and 12, modular slide 100 is shown installed on a staircase 200. As illustrated, ramp section 110 is configured to span three stairs or treads 204 of staircase 200 where stair or tread 204 has a depth or run of between about 10 inches to about 11 inches. One should appreciate, however, that modular slide 100 as illustrated is compatible with virtually any staircase design. For example, a staircase having smaller steps, i.e., having a depth or run of less than about 10 inches, would result in modular slide 100 spanning more than three steps, whereas a staircase having larger steps, i.e., having a depth or run of greater than about 10 inches, would result in modular slide 100 spanning fewer than three steps. Further, one should appreciate that the overall length of modular slide 100 may be altered to conform to virtually any intended staircase, or to span any number of stairs with a single module. For instance, modular slide 100 can span at least two stairs or treads 204 having a depth or run of between about 10 inches to about 11 inches, at least three stairs or treads 204 having a depth or run of between about 10 inches to about 11 inches, at least four stairs or treads 204 having a depth or run of between about 10 inches to about 11 inches, between about 2 to about 6 stairs or treads 204 having a depth or run of between about 10 inches to about 11 inches, or between about 3 to about 5 stairs or treads 204 having a depth or run of between about 10 inches to about 11 inches.

As shown, modular slide 100 is installed on staircase 200 with gripping surface 106 resting on a tread 204*a* of a first step 202*a*, such that underside 122 rests on nosings 206*a-c* of steps 202*a-c*, adjacent treads 204*a-c* being separated by risers 208*a*-208*c*. Also, terminal end 114 of ramp section 110 is shown suspended or hanging above floor 212 so that the terminal end 114 is positioned above the floor 212 without the terminal end 114 being supported at a position directly vertically below the terminal end. Instead, an end portion 150 of the modular slide 100 extends from the tread 204*c*, for instance, in a cantilevered manner. Alternatively, gripping surface 106 can be placed on a higher stair or landing 210 of staircase 200, such that terminal end 114 overhangs a tread of a step, such as tread 204*c* of step 202*c*, without contacting the tread of the step so the end portion 150 of the modular slide 100 extends from the step 202*b*, for instance, in a cantilevered manner. With terminal end 114 hanging or being suspended above floor 212, a landing pad, cushion, or blanket 250 may be placed on floor 212 as a landing area for a user.

Figure 13:
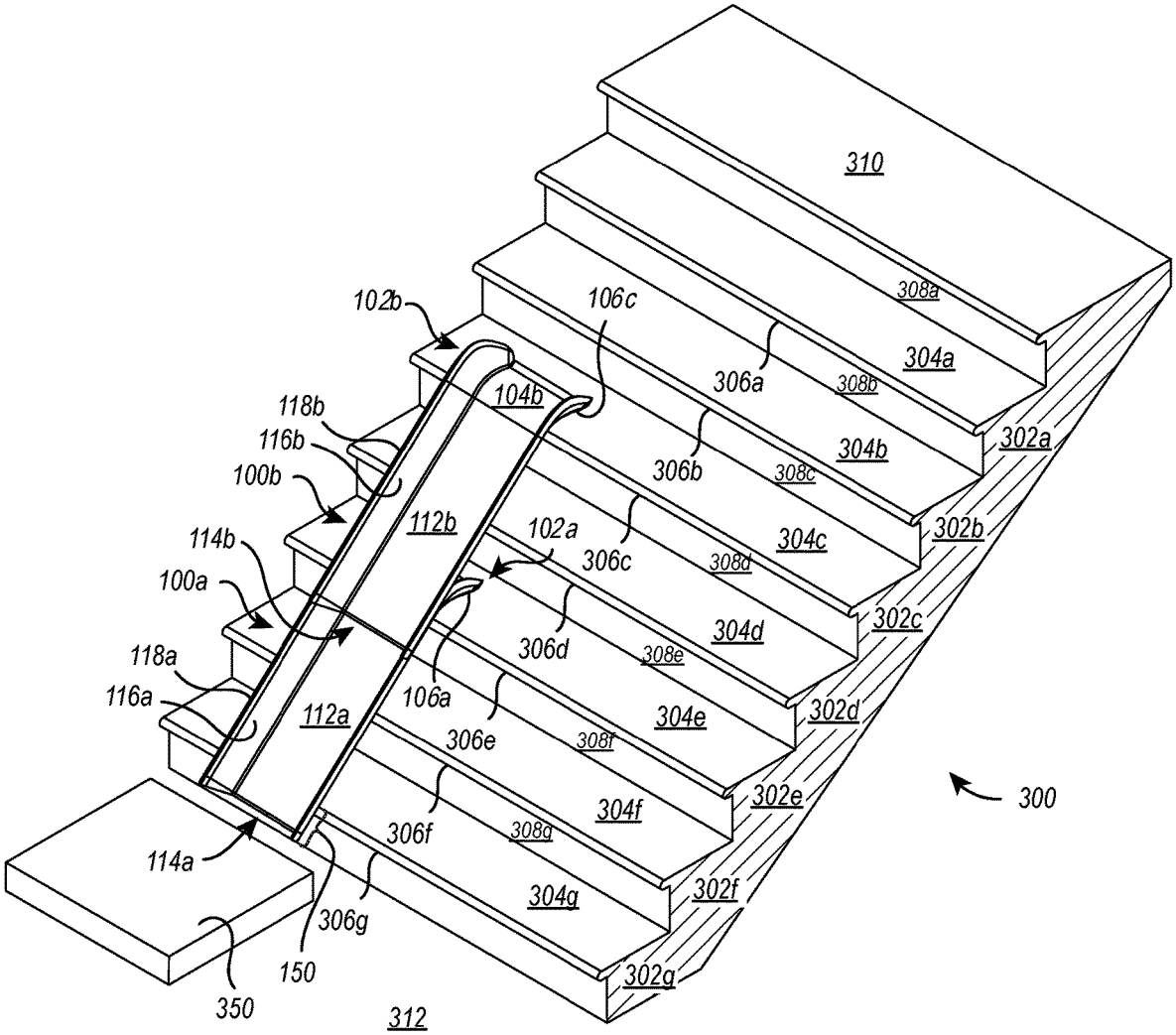
FIG. 13 illustrates a front perspective view of a modular slide assembly with two modular slide apparatus installed on a staircase.
Figure 14:
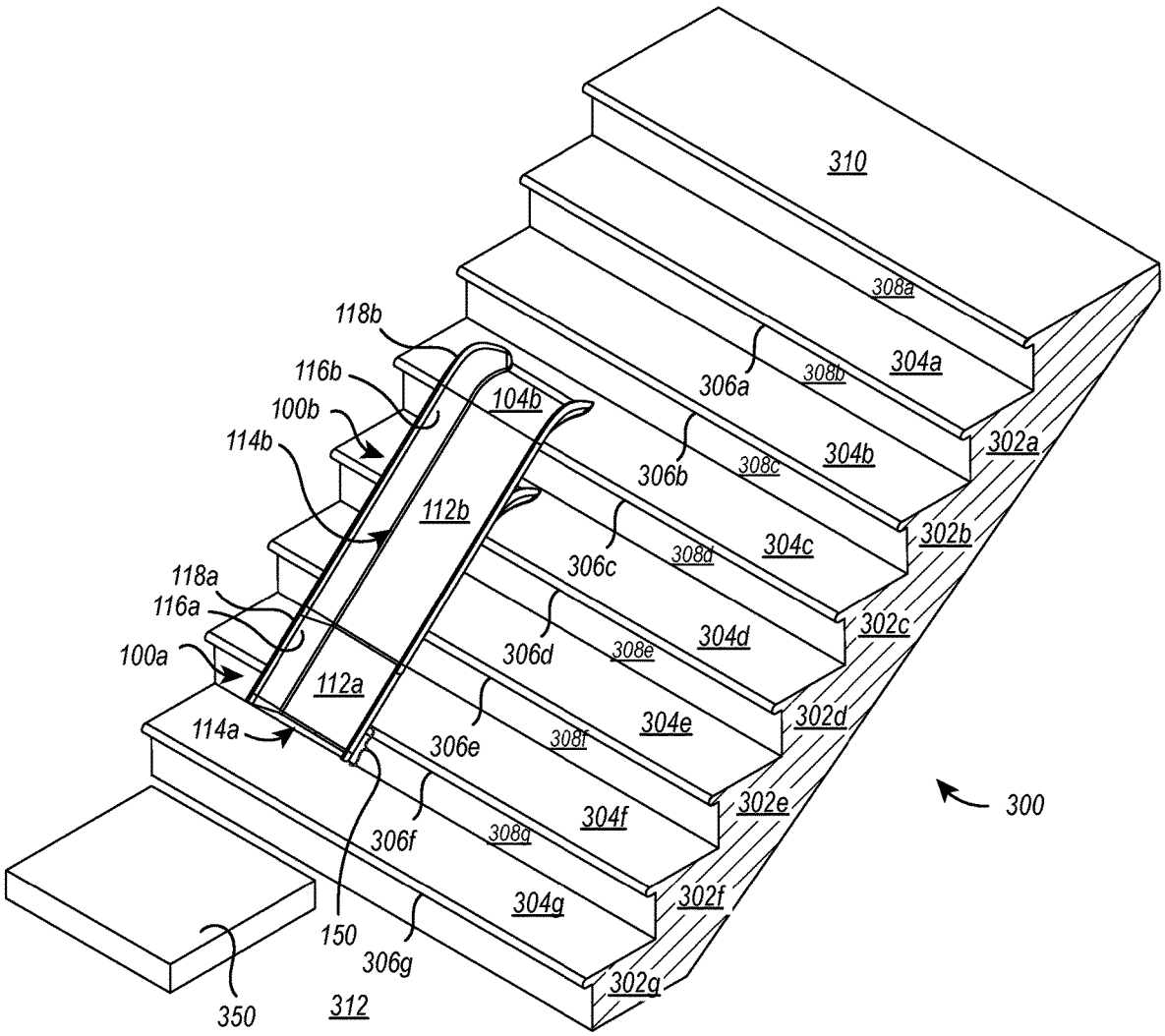
FIG. 14 illustrates a front perspective view of the modular slide assembly of FIG. 11 in an alternative configuration.

Referring to FIGS. 13 and 14, a modular slide assembly with first and second slide modules 100*a*, 100*b* is installed on a staircase 300, the first and second slide modules 100*a*, 100*b* overlapping and nesting with one another to form an extended sliding surface of the modular slide assembly. First and second slide modules 100*a*, 100*b* each include an entry section 102*a*, 102*b* having an entry surface 104*a* (hidden by the second slide module 102*b*), 104*b* defining a seat and a gripping surface 106*a*, 106*b* substantially opposite respective entry surface 104*a*, 104*b*, the gripping surface being configured to interface with a tread 304*a-g* of any stair or step 302*a-g* of staircase 300.

First and second slide modules 100*a*, 100*b* also include respective ramp sections 110*a*, 110*b*, each having an elongated surface 112*a*, 112*b* extending from respective entry surface 104*a*, 104*b* of entry section 102*a*, 102*b* at a downward angle towards a terminal end 114*a*, 114*b* of respective ramp section 110*a*, 110*b*. Each ramp section 110*a*, 110*b* has an underside 122*a*, 122*b* configured to rest upon one or more portions of the stair or step 302*a-g*, such as stair nosings 306*a*-g of staircase 300. Also, sidewalls 116*a*, 116*b* span opposing lateral sides of ramp sections 110*a*, 110*b* and entry sections 102*a*, 102*b*, the sidewalls 116*a*, 116*b* each having an upper edge 128 with a smooth upper surface defining a handrail 118*a*, 118*b*.

As illustrated, underside 122*b* of second slide module 100*b* is sized and shaped to integrate or overlap with entry surface 106*a* and elongated surface 112*a* of first slide module 100*a* to form a modular slide having an extended ramp section. Also, sidewalls 116*b* and handrails 118*b* of second slide module 100*b* are shaped and sized to overlap and integrate with respective sidewalls 116*a* and handrails 118*a* of first slide module 100*a* to form a continuous handrail on each side of the extended ramp section. Embodiments can include first and second slide modules that are substantially identical in shape and size, such that they are interchangeable and can thus be installed in any order on staircase 300.

As shown in FIG. 13, first slide module 100*a* is placed on staircase 300 with gripping surface 106*a* resting on tread 304*e* of step 302*e*, such that elongated surface 112*a* extends across steps 302*e* through 302*g* with terminal end 114*a* suspended over floor 312. Second slide module 100*b* is then placed on staircase 300 with gripping surface 106*b* resting on tread 304*c* of step 302*c*, such that elongated surface 112*b* extends across steps 302*c* through 302*e* with terminal end 114*b* overlapping and nesting with an upper portion of first slide module 100*a*.

In the configuration shown in FIG. 13, the modular slide assembly spans steps 302*c* through 302*g* and forms a continuous slide with continuous opposing handrails across the five steps 302*c* through 302*g*. The modular slide assembly is frictionally mounted to staircase 300 by virtue of gripping surfaces 106*a*, 106*b* of modular slides 100*a*, 100*b* integrating with steps 302*e*, 302*c*, respectively. The elongated surfaces 112*a*, 112*b* of slide modules 100*a*, 100*b* are supported by the stair nosings 306*c* through 306*g* upon which they rest. As terminal end 114*a* is suspended over floor 312, a cushion, blanket, or landing pad 350 may be provided on floor 312 as additional padding for user when to land on when exiting terminal end 114*a* of the modular slide assembly.

As shown in FIGS. 13 and 14, slide modules 100*a*, 100*b* can overlap one another by varying amounts to form extended slides spanning a varying number of steps. In the configuration shown in FIG. 13, for example, first slide module 100*a* is placed on staircase 300 with gripping surface 106*a* resting on tread 304*e* of step 302*e*, such that elongated surface 112*a* extends across steps 302*e* through 302*g* with terminal end 114*a* suspended or overhanging above the floor 312 so that the end portion 150 of the modular slide 100 extends from the step 302*g*, for instance, in a cantilevered manner. Second slide module 100*b* is then placed on staircase 300 with gripping surface 106*b* resting on tread 304*c* of step 302*c*, such that elongated surface 112*b* extends across steps 302*c* through 302*e*, and a portion of step 302*f*, with terminal end 114*b* overlapping and nesting with an upper portion of first slide module 100*a*.

In the configuration shown in FIG. 14, the modular slide assembly spans steps 302*c* through 302*f*, and a portion of step 302*g*, and forms a continuous slide with continuous opposing handrails across the four steps 302*c* through 302*f*, and a portion of step 302*g*. The modular slide assembly is frictionally mounted to staircase 300 by virtue of gripping surfaces 106*a*, 106*b* of modular slides 100*a*, 100*b* integrating with treads 304*d*, 304*c*, respectively. The elongated surfaces 112*a*, 112*b* of slide modules 100*a*, 100*b* are supported by the stair or step nosings 306*c* through 306*f* upon which they rest. The terminal end 114*a* of modular slide 100*a* is suspended or overhangs the step 302*g* so that the end portion 150 of the modular slide 100 extends from the step 302*f*, for instance, in a cantilevered manner One should appreciate that various configurations of modular slide assemblies can be accomplished by virtue of the relative placement of a plurality of slide modules according to embodiments of the present disclosure. For example, the modular slide assembly of FIGS. 13 and 14 can be arranged to span either four or five stairs or steps of staircase 300. Additional slide modules may be introduced to span additional stairs or steps, fewer modules can be used to span fewer stairs or steps, and modules of different lengths can also be implemented depending on the intended staircase. For instance, and not by way of limitation, a single slide module 100 can span up to about 3 stairs, two slide modules 100 can span up to about 5 stairs, three slide modules 100 can span up to about 7 stairs, and four slide modules 100 can span up to about 9 stairs where the stairs have a depth or run of between about 10 inches to about 11 inches. It will be understood that other lengths and span capabilities of the slide modules can be attained.

Figure 15:
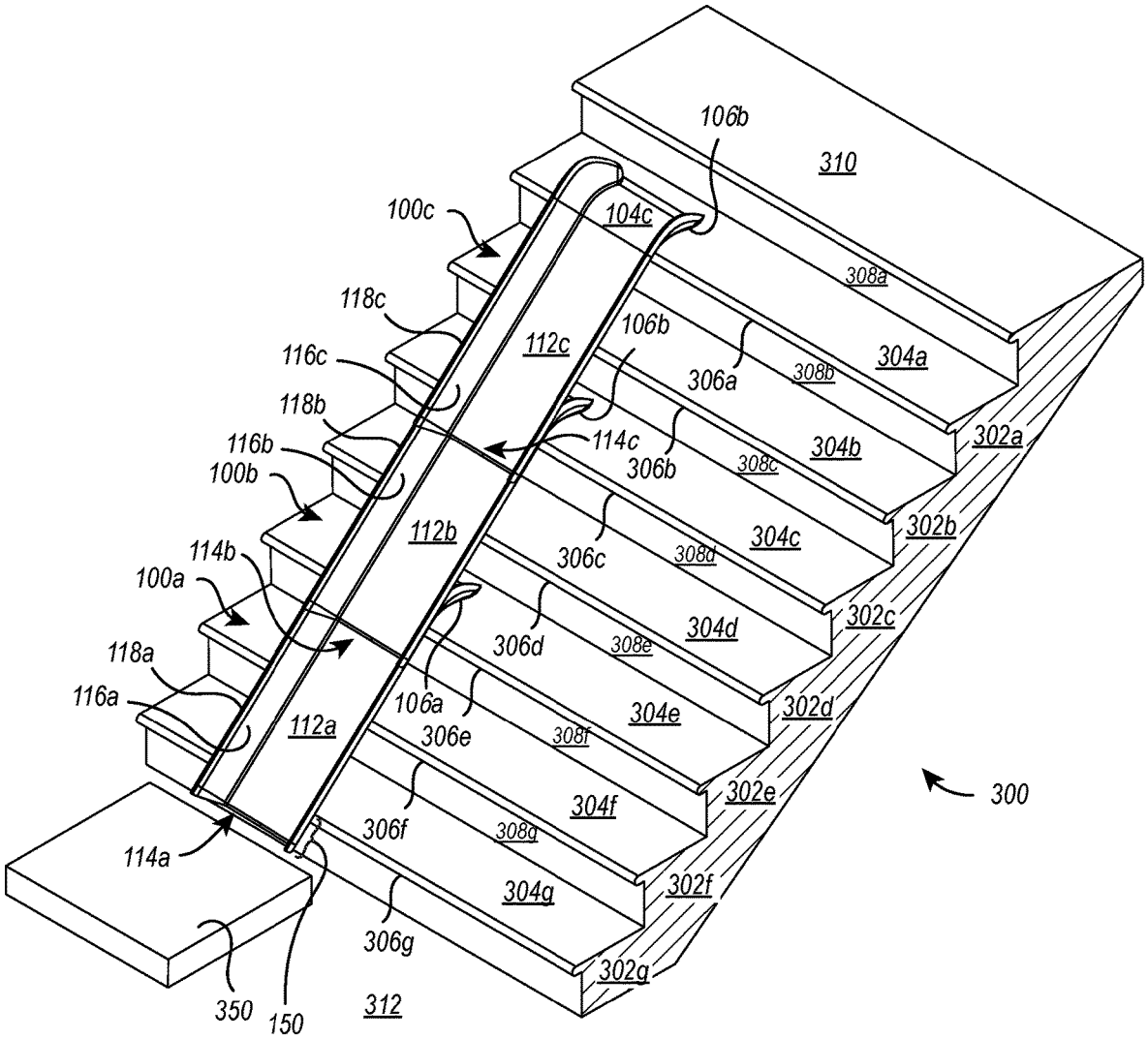
FIG. 15 illustrates a front perspective view of a modular slide assembly with three modular slide apparatus installed on a staircase.

FIG. 15, for example, illustrates a modular slide assembly with three slide modules 100*a-c* installed on staircase 300, the three slide modules 100*a-c* overlapping and nesting with one another to form an extended sliding surface of the modular slide assembly having the sidewalls 116*a-c* and the handrails 118*a-c*. As shown, a first slide module 100*a* is placed on staircase 300 with gripping surface 106*a* resting on tread 304*e* of step 302*e*, such that elongated surface 112*a* extends across steps 302*e* through 302*g* with terminal end 114*a* being suspended above or overhanging floor 310 so that the end portion 150 of the modular slide 100 extends from the step 304*g*, for instance, in a cantilevered manner. A second slide module 100*b* is then placed on staircase 300 with gripping surface 106*b* resting on tread 304*c* of step 302*c*, such that elongated surface 112*b* extends across steps 302*c* through 302*e* with terminal end 114*b* overlapping and nesting with an upper portion of first slide module 100*a*. A third slide module 100*c* is then placed on staircase 300 with gripping surface 106*c* resting on tread 304*a* of step 302*a*, such that elongated surface 112*c* extends across steps 302*a* through 302*c* with terminal end 114*c* overlapping and nesting with an upper portion of second slide module 100*b*. The entry surface 104*c* of the third slide module 100*c* provides access for a user.

In the configuration shown in FIG. 15, the modular slide assembly spans steps 302*a* through 302*g* and forms a continuous slide with continuous opposing handrails across the seven steps 302*a* through 302*g*. The modular slide assembly is frictionally mounted to staircase 300 by gripping surfaces 106*a-c* of modular slides 100*a-c* integrating with treads 302*e*, 302*c*, and 302*a*, respectively. The elongated surfaces 112*a-c* of slide modules 100*a-c* are supported by the stair or step nosings 306*a* through 306*g* upon which they rest. Alternatively, each slide module 100*a-c* can be moved up by a single step of staircase 300, such that gripping surface 106*c* of third slide module 100*c* integrates with landing 308 with terminal end 114*a* of first slide module 100*a* hanging or being suspended above step 302*g*.

The following discussion now refers to methods that may be performed for installing a modular slide assembly on a staircase. Although the method may be discussed in a certain order, no particular ordering is required unless specifically stated or required because a method step and/or act is dependent on another act being completed prior to the act being performed.

Embodiments of a method for installation of a modular slide on a staircase can include installation of a first slide module on a first step, wherein a gripping surface on an underside of the first slide module interfaces with a tread of the first step, and wherein a ramp section of the first slide extends over one or more successive steps below the first step, each of the one or more successive steps being located below the first step. Some embodiments also include installation of a pad on a floor at a bottom end of a staircase, the pad acting as a landing area.

An extended modular slide can be assembled by installing a second slide module on a second step, the second step being at least one step above the first step, wherein a gripping surface on an underside of the second slide module interfaces with a tread of the second step, and wherein a ramp section of the second slide module overlaps and integrates with an upper portion of the first slide module to form a continuous slide surface. In some embodiments, the first and second slide modules are substantially identical in size and shape, while other embodiments may comprise one slide that is of a greater or lesser length than the other slide module.

Embodiments also include slide modules having an entry surface substantially opposite the gripping surface thereof, such that friction between the gripping surface and the tread of the step upon which it rests increases when a user sits on the entry surface. The friction between the gripping surface and the tread can be increased further by a rubber material integrated with or attached to the gripping surface.

Embodiments can also include first and second slide modules having at least one sidewall defining a handrail, the sidewall of the second slide module being configured to overlap and integrate with the sidewall of the first slide module to form a continuous handrail corresponding to the continuous slide surface formed by the elongated surfaces of first and second slide modules.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

Following are some further example embodiments of the invention. These are presented only by way of example and are not intended to limit the scope of the invention in any way. Further, any example embodiment can be combined with one or more of the example embodiments.

Embodiment 1. A modular slide apparatus for use on a staircase, the modular slide apparatus comprising: an entry section having an entry surface defining a seat and a gripping surface substantially opposite the entry surface, the gripping surface being configured to interface with a tread of an upper stair of the staircase; a ramp section having an elongated surface extending from the entry surface of the entry section at a downward angle towards a terminal end of the ramp section and an underside configured to rest upon portions of the staircase; and two sidewalls spanning opposing lateral sides of both the ramp section and the entry section, the two sidewalls each comprising an upper edge having a smooth upper surface defining a handrail.

Embodiment 2. The modular slide apparatus according to embodiment 1, wherein the terminal end of the ramp section is configured to interface with an additional modular slide apparatus to form a modular slide of increased length.

Embodiment 3. The modular slide apparatus according to any of embodiments 1-2, wherein the gripping surface comprises a rubber material configured to increase friction between the gripping surface and the tread of the upper stair.

Embodiment 4. The modular slide apparatus according to any of embodiments 1-3, wherein the ramp section comprises a length such that the terminal end overhangs or is suspended above a floor or tread of a lower stair of the staircase when in use.

Embodiment 5. The modular slide apparatus according to any of embodiments 1-4, further comprising a curved lateral profile between the gripping surface of the entry section and an upper end of the ramp section, such that the entry surface overhangs or is suspended above the tread of the upper stair when in use.

Embodiment 6. The modular slide apparatus according to any of embodiments 1-5, wherein the two sidewalls extend upwardly at an angle away from one another.

Embodiment 7. The modular slide apparatus according to any of embodiments 1-6, wherein each of the two sidewalls comprises a terminal edge proximate the terminal end of the ramp section, the terminal edge being angled away from the entry section.

Embodiment 8. The modular slide apparatus according to any of embodiments 1-7, wherein the ramp section is configured to span three stairs of a standard residential staircase.

Embodiment 9. The modular slide apparatus according to any of embodiments 1-8, wherein a substantial portion of the modular slide apparatus is constructed of a single piece of acrylonitrile butadiene styrene (ABS) plastic.

Embodiment 10. A modular slide assembly for use on a staircase, the modular slide assembly comprising first and second slide modules, each comprising: an entry section comprising an entry surface defining a seat and a gripping surface substantially opposite the entry surface, the gripping surface being configured to interface with a tread of a stair of the staircase; a ramp section comprising an elongated surface extending from the entry surface of the entry section at a downward angle towards a terminal end of the ramp section and an underside configured to rest upon one or more stair nosings of the staircase; and left and right sidewalls spanning opposing lateral sides of both the ramp section and the entry section, the two sidewalls each comprising an upper edge having a smooth upper surface defining a handrail, wherein the underside of the second slide module is sized and shaped to integrate with the entry surface and the elongated surface of the first slide module to form a modular slide having an extended ramp section.

Embodiment 11. The modular slide assembly according to embodiment 10, wherein the respective gripping surfaces of the first and second slide modules integrate with separate stair treads of the staircase when the extended ramp section is formed.

Embodiment 12. The modular slide assembly according to any of embodiments 10-11, wherein the first and second slide modules are substantially identical in shape and size.

Embodiment 13. The modular slide assembly according to any of embodiments 10-12, wherein the left and right sidewalls of the second slide module are configured to overlap and integrate with respective left and right sidewalls of the first slide module to form continuous left and right sidewalls of the modular slide.

Embodiment 14. The modular slide assembly according to any of embodiments 10-12 using the modular slide apparatus of any of embodiments 1-9.

Embodiment 15. A method for installation of a modular slide on a staircase comprising: installing a first slide module on a first step, wherein a gripping surface on an underside of the first slide module interfaces with a tread of the first step, and wherein a ramp section of the first slide extends over one or more successive steps below the first step, each of the one or more successive steps being located below the first step; and installing a second slide module on a second step, the second step being at least one step above the first step, wherein a gripping surface on an underside of the second slide module interfaces with a tread of the second step, and wherein a ramp section of the second slide module overlaps and integrates with an upper portion of the first slide module to form a continuous slide surface.

Embodiment 16. The method according to embodiment 15, wherein the first and second slide modules are substantially identical in size and shape.

Embodiment 17. The method according to any of embodiments 15-16, wherein the second slide module comprises an entry surface substantially opposite the gripping surface thereof, such that friction between the gripping surface and the tread of the second step increases when a user sits on the entry surface.

Embodiment 18. The method according to any of embodiments 15-17, further comprising installing a pad on a floor at a bottom end of a staircase, the pad acting as a landing area.

Embodiment 19. The method according to any of embodiments 15-18, wherein each of the first and second slide modules are configured to span three stairs of a standard residential staircase, such that the continuous slide surface spans up to five stairs when the second slide module overlaps the upper portion of the first slide module.

Embodiment 20. The method according to any of embodiments 15-19, wherein the first and second slide modules each comprise at least one sidewall defining a handrail, the sidewall of the second slide module being configured to overlap and integrate with the sidewall of the first slide module to form a continuous handrail corresponding to the continuous slide surface.

Embodiment 21. The method according to any of embodiments 15-20, further comprising installing a third slide module on a third step, the third step being at least one step above the second step, wherein a gripping surface on an underside of the third slide module interfaces with a tread of the third step, and wherein a ramp section of the third slide module overlaps and integrates with an upper portion of the second slide module to extend the continuous slide surface.

Embodiment 22. The method according to any of embodiments 15-21 using the modular apparatus of any of embodiments 1-9 and/or the modular slide assembly of any of embodiments 10-14.

The present invention may be embodied in other specific forms without departing from its spirit or characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A modular slide apparatus for use on a staircase, the modular slide apparatus comprising:

an entry section comprising:

an entry surface defining a seat; and a gripping surface substantially opposite the entry surface, the gripping surface being configured to interface with a tread of an upper stair of the staircase;

a ramp section comprising:

an elongated surface extending from the entry surface of the entry section at a downward angle towards a terminal end of the ramp section wherein the elongated surface comprises a first planar surface; and an underside configured to rest upon portions of the staircase; and a first sidewall and a second sidewall spanning opposing lateral sides of both the ramp section and the entry section, the the first sidewall and second sidewall each comprising an upper edge having a smooth upper surface defining a handrail, wherein the first sidewall comprises a second planar surface extending from a lower edge proximal the elongated surface to the upper edge, and wherein the upper edge extends further than the lower edge when measured along a length of the ramp section.

2. The modular slide apparatus of claim 1, wherein the terminal end of the ramp section is configured to interface with an additional modular slide apparatus to form a modular slide of increased length.

3. The modular slide apparatus of claim 1, wherein the gripping surface comprises a rubber material configured to increase friction between the gripping surface and the tread of the upper stair.

4. The modular slide apparatus of claim 1, wherein the ramp section comprises a length such that the terminal end is suspended above a floor or tread of a lower stair of the staircase when in use.

5. The modular slide apparatus of claim 1, further comprising a curved lateral profile between the gripping surface of the entry section and an upper end of the ramp section, such that the entry surface is suspended above the tread of the upper stair when in use.

6. The modular slide apparatus of claim 1, wherein the two sidewalls extend upwardly at an angle away from one another.

7. The modular slide apparatus of claim 1, wherein each of the two sidewalls comprises a terminal edge proximate the terminal end of the ramp section, the terminal edge being angled away from the entry section.

8. The modular slide apparatus of claim 1, wherein the ramp section is configured to span three stairs of a standard residential staircase.

9. The modular slide apparatus of claim 1, wherein a substantial portion of the modular slide apparatus is constructed of a single piece of acrylonitrile butadiene styrene (ABS) plastic.

10. A modular slide assembly for use on a staircase, the modular slide assembly comprising:

first and second slide modules, each comprising:

an entry section comprising:

an entry surface defining a seat; and a gripping surface substantially opposite the entry surface, the gripping surface being configured to interface with a tread of a stair of the staircase;

a ramp section comprising:

an elongated surface extending from the entry surface of the entry section at a downward angle towards a terminal end of the ramp section wherein the elongated surface comprises a first planar surface; and an underside configured to rest upon one or more stair nosings of the staircase; and left and right sidewalls spanning opposing lateral sides of both the ramp section and the entry section, the left and right sidewalls each comprising an upper edge having a smooth upper surface defining a handrail, wherein the left sidewall comprises a second planar surface extending from the a lower edge proximal the elongated surface to the upper edge, and wherein the upper edge extends further than the lower edge when measured along a length of the ramp section, wherein the underside of the second slide module is sized and shaped to integrate with the entry surface and the elongated surface of the first slide module to form a modular slide having an extended ramp section.

11. The modular slide assembly of claim 10, wherein the gripping surfaces of the first and second slide modules integrate with separate stair treads of the staircase when the extended ramp section is formed.

12. The modular slide assembly of claim 10, wherein the first and second slide modules are substantially identical in shape and size.

13. The modular slide assembly of claim 10, wherein the left and right sidewalls of the second slide module are configured to overlap and integrate with respective left and right sidewalls of the first slide module to form continuous left and right sidewalls of the modular slide.

* * * * *